US010779615B2

(12) United States Patent
Minami et al.

(10) Patent No.: US 10,779,615 B2
(45) Date of Patent: Sep. 22, 2020

(54) ARTICLE OF FOOTWEAR WITH SENSORY ELEMENTS

(71) Applicant: NIKE, Inc., Beaverton, OR (US)

(72) Inventors: Tetsuya T. Minami, Portland, OR (US); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/503,891

(22) Filed: Oct. 1, 2014

(65) Prior Publication Data

US 2016/0095389 A1 Apr. 7, 2016

(51) Int. Cl.

| | |
|---|---|
| ***A43B 3/00*** | (2006.01) |
| ***A43B 7/14*** | (2006.01) |
| ***A43B 23/02*** | (2006.01) |
| ***A43B 5/02*** | (2006.01) |

(52) U.S. Cl.

CPC ..... *A43B 23/026* (2013.01); *A43B 5/025* (2013.01); *A43B 7/146* (2013.01); *A43B 23/025* (2013.01); *A43B 23/0245* (2013.01); *A43B 23/0255* (2013.01)

(58) Field of Classification Search

CPC . A43B 23/026; A43B 23/0255; A43B 23/025; A43B 23/0245; A43B 7/146

USPC ..... 36/45, 3 A, 10

See application file for complete search history.

(56) References Cited

U.S. PATENT DOCUMENTS

| | | | | |
|---|---|---|---|---|
| 2,330,317 A | | 9/1943 | Stewart | |
| 3,191,321 A | * | 6/1965 | Eugen | A43B 5/02 36/133 |
| 4,451,934 A | * | 6/1984 | Gioello | A41B 9/00 2/113 |
| 4,715,133 A | | 12/1987 | Hartjes et al. | |
| 4,811,501 A | * | 3/1989 | Okayasu | A43C 13/14 36/77 R |
| 4,823,799 A | * | 4/1989 | Robbins | A43B 7/146 36/129 |
| 5,456,032 A | * | 10/1995 | Matsumoto | A43B 3/0005 200/61.48 |
| 5,599,088 A | * | 2/1997 | Chien | A43B 1/0072 200/61.45 R |

(Continued)

FOREIGN PATENT DOCUMENTS

| | | |
|---|---|---|
| CA | 2052070 A1 | 1/1993 |
| DE | 8304272 U1 | 10/1983 |

(Continued)

OTHER PUBLICATIONS

International Search Report and Written Opinion dated Oct. 21, 2015 in PCT Application No. PCT/US2015/042822.

(Continued)

*Primary Examiner* — Clinton T Ostrup

*Assistant Examiner* — Cameron A Carter

(74) *Attorney, Agent, or Firm* — Quinn IP Law

(57) ABSTRACT

An article of footwear includes sensory elements. The sensory elements are embedded in an upper of an article of footwear, the upper having a first layer and a second layer. Sensory elements are proximally disposed toward a foot when contacted by an object. Sensory elements may partially protrude from the first layer and/or the second layer. Sensory elements may also be fully covered between the first layer and the second layer.

17 Claims, 16 Drawing Sheets

(56) References Cited

U.S. PATENT DOCUMENTS 5,607,749 A * 3/1997 Strumor ..... A43B 7/146 297/DIG. 8
5,768,802 A 6/1998 Bramani
5,915,819 A 6/1999 Gooding
5,946,825 A 9/1999 Koh et al.
6,082,024 A 7/2000 Del Biondi
6,138,281 A * 10/2000 Chiaruttini ..... A41B 11/00 2/239
6,275,997 B1 8/2001 Richardson
6,516,540 B2 2/2003 Seydel et al.
6,523,282 B1 * 2/2003 Johnston ..... A43B 5/02 36/133
6,691,432 B2 2/2004 Masseron
6,727,469 B1 * 4/2004 Parker ..... A43B 3/0005 219/211
6,732,457 B2 5/2004 Gardiner
7,013,588 B2 * 3/2006 Chang ..... A43B 1/0054 36/141
7,089,690 B2 * 8/2006 Krstic ..... A43B 3/0042 36/29
7,140,129 B2 * 11/2006 Newson ..... A43B 5/18 36/100
7,264,599 B1 * 9/2007 Milligan ..... A43B 3/0005 36/141
7,290,357 B2 11/2007 McDonald et al.
7,346,936 B2 3/2008 Vargas et al.
7,665,229 B2 2/2010 Kilgore et al.
7,752,772 B2 7/2010 Hatfield et al.
7,849,609 B2 12/2010 Edington
7,913,420 B2 3/2011 Arizumi
7,918,811 B2 4/2011 Lussier et al.
7,941,943 B2 * 5/2011 Baker ..... A43B 5/02 36/133
8,006,411 B2 8/2011 Manz et al.
8,162,860 B1 4/2012 Ali
8,215,032 B2 7/2012 Sokolowski et al.
8,333,022 B2 12/2012 Crowley, II et al.
8,387,281 B2 3/2013 Loverin et al.
8,661,712 B2 * 3/2014 Aveni ..... A43B 23/0215 36/3 A
8,844,171 B2 * 9/2014 Eder ..... A43B 1/0009 36/132
8,950,087 B2 2/2015 Baucom et al.
9,585,434 B2 * 3/2017 Van Atta ..... A43B 5/025
2005/0172515 A1 * 8/2005 Ungari ..... A43B 1/0054 36/88
2005/0188562 A1 * 9/2005 Clarke ..... A43B 5/18 36/15
2005/0241189 A1 * 11/2005 Elkington ..... A43B 3/0047 36/117.6
2006/0000119 A1 1/2006 Endo
2006/0048413 A1 * 3/2006 Sokolowski ..... A43B 23/0235 36/45
2007/0044346 A1 * 3/2007 Ungari ..... A43B 3/0005 36/136
2007/0180730 A1 * 8/2007 Greene ..... A43B 9/00 36/3 A
2008/0078106 A1 4/2008 Montgomery
2009/0083993 A1 * 4/2009 Plank ..... A43B 3/0078 36/7.3
2010/0011620 A1 * 1/2010 Nakano ..... A43B 19/00 36/88
2010/0175276 A1 * 7/2010 Dojan ..... A43B 3/26 36/47
2011/0252671 A1 10/2011 Maron et al.
2012/0023777 A1 2/2012 Greene
2012/0023786 A1 * 2/2012 Dojan ..... A43B 23/0275 36/25 R
2012/0055047 A1 3/2012 Youngs
2012/0167414 A1 * 7/2012 Shrairman ..... A43B 7/1415 36/88
2012/0240432 A1 9/2012 Lambertz
2012/0291315 A1 11/2012 Baucom et al.
2012/0317843 A1 * 12/2012 Bove ..... A43B 1/0054 36/25 R
2013/0152424 A1 * 6/2013 Dojan ..... A43B 23/0225 36/83
2015/0366281 A1 * 12/2015 Miller ..... B32B 27/12 428/136
2016/0143395 A1 * 5/2016 Van Atta ..... A43B 23/0235 36/48

FOREIGN PATENT DOCUMENTS

DE 3520956 A1 1/1987
DE 202010017958 U1 6/2013
EP 1557105 A1 7/2005
EP 2494879 A1 * 9/2012 ..... A43B 3/0042
EP 2594146 A1 5/2013
JP H05115308 A 5/1993
KR 20070032569 A 3/2007
SU 971240 A1 11/1982
WO 9305674 A1 4/1993
WO 2004014171 A1 2/2004
WO 2007087581 A1 8/2007
WO 2015108593 A1 7/2015
WO 2016085553 A1 6/2016

OTHER PUBLICATIONS

International Search Report and Written Opinion for Application No. PCT/US2014/062104, dated Jan. 29, 2015.
International Search Report and Written Opinion dated Nov. 30, 2015 in PCT/US2015/047956.
International Search Report and Written Opinion dated Oct. 21, 2015 in PCT/US2015/042822.
International Search Report and Written Opinion dated Oct. 21, 2015 for PCT Application No. PCT/US2015/042822.
Non Final Office Action dated Jun. 14, 2016 for U.S. Appl. No. 14/554,524, filed Nov. 26, 2014.

* cited by examiner

ARTICLE OF FOOTWEAR WITH SENSORY ELEMENTS

BACKGROUND

The present embodiments relate generally to articles of footwear, and in particular to articles of footwear with uppers.

Articles of footwear generally include an upper and a sole assembly. The upper may be formed from a variety of materials that are stitched (sewn) or adhesively bonded together to form a space or void within the footwear in order to support and secure a foot. The sole assembly is secured to a lower portion of the upper and is generally positioned between the foot and the ground. In many articles of footwear, including athletic footwear styles, the sole assembly often incorporates an insole, a midsole, and an outsole.

SUMMARY

In one aspect, an article of footwear comprises a sole structure and an upper connected to the sole structure. The upper comprises a first layer, a second layer, and a plurality of sensory elements. The first layer has a first exterior portion and a first interior portion, the second layer has a second exterior portion and second interior portion, and the plurality of sensory elements is disposed between the first layer and the second layer. The upper further comprises a plurality of sensory portions corresponding to portions of the upper in contact with the plurality of sensory elements. The upper further comprises an intermediate portion extending between the plurality of sensory portions. The second interior portion of the second layer is engaged with the first interior portion of the first layer in the intermediate portion of the upper, and the second interior portion is separated from the first interior portion in the plurality of sensory portions of the upper.

In another aspect, an article of footwear comprises a sole structure and an upper connected to the sole structure. The upper comprises a base portion and the upper comprises a plurality of sensory elements embedded within the base portion. The base portion has a first hardness and the plurality of sensory elements has a second hardness. The second hardness is greater than the first hardness.

In another aspect, an article of footwear comprises a sole structure and an upper connected to the sole structure. The upper comprises a base portion and the upper comprising a plurality of sensory elements embedded within the base portion. The positions of the plurality of sensory elements are fixed with respect to the base portion. The plurality of sensory elements is substantially incompressible.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
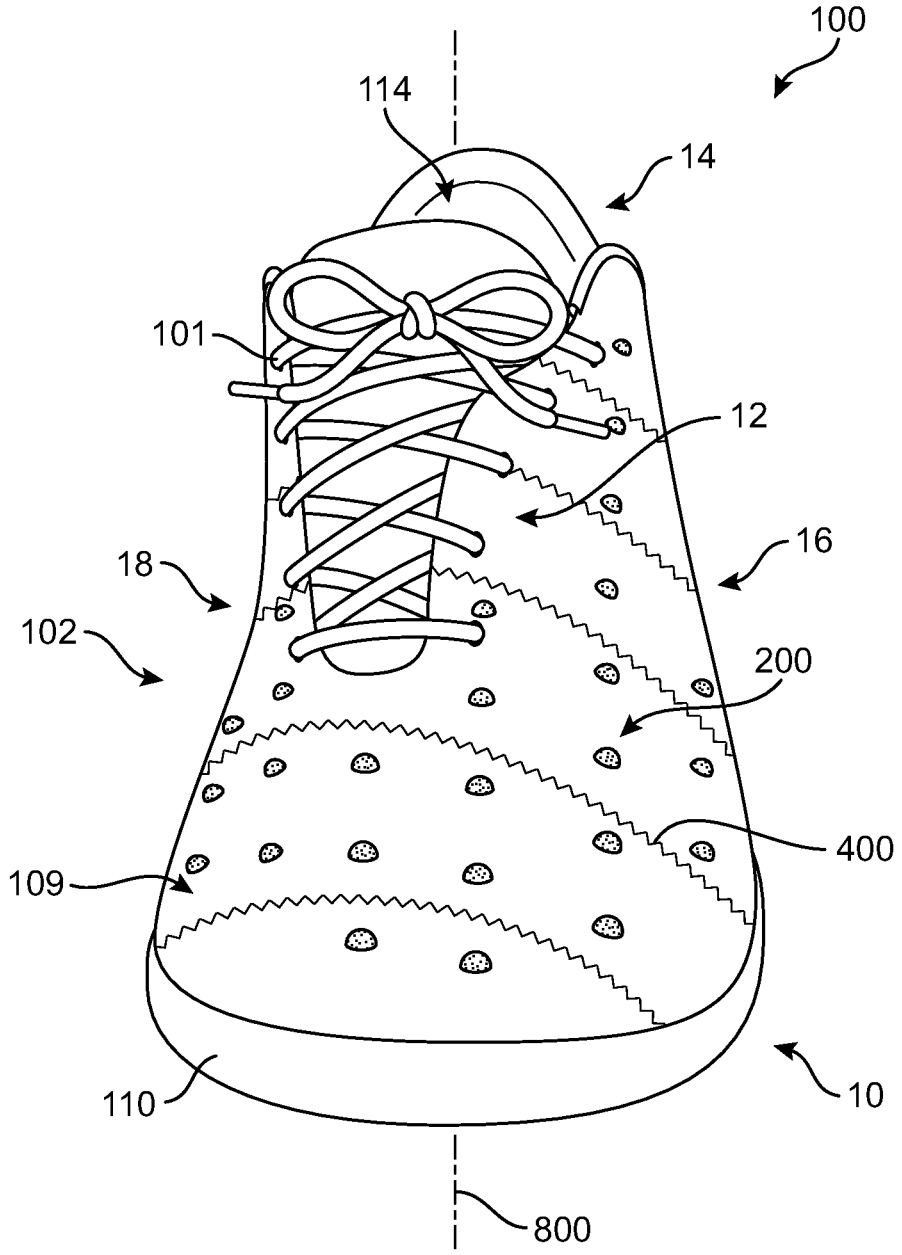
FIG. 1 is a front isometric view of an embodiment of an article of footwear having several sensory elements.

FIG. 1 illustrates an isometric view of an embodiment of an article of footwear 100, or simply article 100, having a plurality of sensory elements 200 on the article of footwear 100. Although the embodiments throughout this detailed description depict articles configured as athletic articles of footwear, in other embodiments the articles may be configured as various other kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments, articles may be configured as various kinds of non-sports related footwear, including, but not limited to: slippers, sandals, high heeled footwear, loafers as well as any other kinds of footwear.

Articles are generally made to fit various sizes of feet. In the embodiments shown, the various articles are configured with the same footwear size. In different embodiments, the articles could be configured with any footwear sizes, including any conventional sizes for footwear known in the art. In some embodiments, an article of footwear may be designed to fit the feet of a child. In other embodiments, an article of footwear may be designed to fit the feet of an adult. Still, in other embodiments, an article of footwear may be designed to fit the feet of a man or a woman.

In some embodiments, an article of footwear may include an upper and a sole system. In the embodiment shown in FIG. 1, article 100 has upper 102 attached to sole system 110. Sole system 110 is secured to an upper and extends between the foot and the ground when an article is worn. In different embodiments, sole system 110 may include different components. For example, sole system 110 may include an outsole, a midsole, and/or an insole. In some cases, one or more of these components may be optional.

Sole system 110 may provide one or more functions for an article. For example, in some embodiments, sole system 110 may be configured to provide traction for an article. In addition to providing traction, sole system 110 may attenuate ground reaction forces when compressed between the foot and the ground during walking, running or other ambulatory activities. The configuration of sole system 110 may vary significantly in different embodiments to include a variety of conventional or non-conventional structures. In some cases, the configuration of sole system 110 can be selected according to one or more types of ground surfaces on which sole system 110 may be used. Examples of ground surfaces include, but are not limited to: natural turf, synthetic turf, dirt, as well as other surfaces.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In some embodiments, upper 102 could further include provisions for fastening article 100 to a foot, such as a hook and look system (Velcro, for example) and may include still other provisions found in footwear uppers. In the embodiment shown in FIG. 1, a lacing system 101 is used for fastening article 100 after a foot enters foot receiving portion 114 of upper 102.

Upper 102 may be made of one or several materials that comprise a base portion 109 of upper 102. Base portion 109 may be configured to cover a foot and may generally form the enclosure or interior cavity that receives a foot. In some embodiments, additional elements could be integrated into base portion 109 in order to modify various properties and/or the functionality of upper 102. Base portion 109 could also be comprised of one, two, three or more layers in various embodiments.

Figure 3:
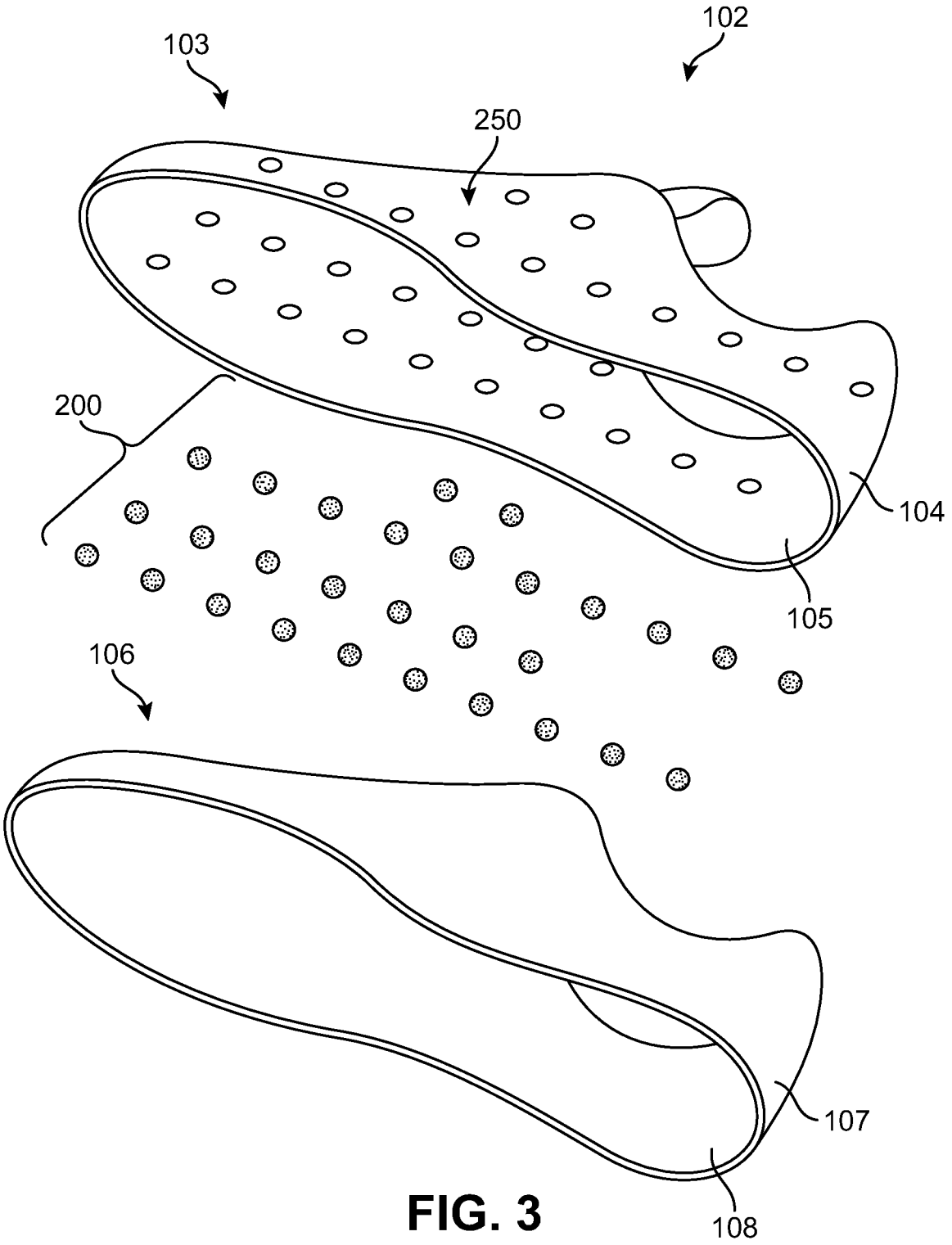
FIG. 3 is an exploded view of the article of footwear shown in FIG. 1.

Some embodiments of upper 102 include leather, synthetic materials (such as plastic or synthetic leather), mesh, or a combination thereon. In FIG. 1, base portion 109 of upper 102 may be made of a leather or synthetic leather material. Base portion 109 may also include two or more layers. For example as shown in FIG. 3, base portion 109 of upper 102 includes first layer 103 and second layer 106.

Referring to FIG. 1, for purposes of reference, upper 102 may be divided into forefoot portion 10, midfoot portion 12 and heel portion 14. Forefoot portion 10 may be generally associated with the toes and joints connecting the metatarsals with the phalanges. Midfoot portion 12 may be generally associated with the metatarsals of a foot. Likewise, heel portion 14 may be generally associated with the heel of a foot, including the calcaneus bone. In addition, upper 102 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14. It will be understood that forefoot portion 10, midfoot portion 12 and heel portion 14 are only intended for purposes of description and are not intended to demarcate precise regions of upper 102. Likewise, lateral side 16 and medial side 18 (not shown) are intended to represent generally two sides of upper 102, rather than precisely demarcating upper 102 into two halves. As shown in FIG. 1, article of footwear 100 is intended to be used with a left foot; however, it should be understood that the following description may equally apply to a mirror image of article of footwear that is intended for use with a right foot (not shown).

For consistency and convenience, directional adjectives are employed throughout this detailed description corresponding to the illustrated embodiments. The term "lateral" as used throughout this detailed description and in the claims refers to a direction extending along a width of a component. For example, the lateral direction of upper 102 may extend between medial side 18 and lateral side 16 of upper 102. Additionally, the term "distal" as used throughout this detailed description and in the claims refers to a direction directed away from a foot, while the term "proximal" as used throughout this detailed description and in the claims refers to a direction directed towards the foot. It will be understood that each of these directional adjectives may be applied to individual components of an article, such as an upper and/or a sole structure.

Embodiments can include provisions to facilitate proprioception at the foot. In some embodiments, an article may include provisions that enhance a wearer's awareness of the part of an article that may be in contact with an object, such as a ball. In some embodiments, an article of footwear may include various sensory elements to enhance proprioceptive feedback. In a sport like soccer, for example, such proprioceptive feedback could allow for improved ball control and/or kicking as the wearer may be more aware of the location of the ball relative to different parts of the foot.

The term "sensory element" may refer to an element having a geometry and/or material properties that facilitate proprioception and/or help transmit other tactile information from an outer surface of an article to a foot. In the exemplary embodiments of FIGS. 1-15, sensory elements may generally comprise approximately spherical structures. In some embodiments, for example, sensory elements could be ball-bearings, beads or other similar structures. In other embodiments, however, sensory elements could have any other geometries that may facilitate proprioception. Examples of three-dimensional geometries for sensory elements include, but are not limited to: rectangular prisms, cubes, triangular prisms, hexagonal prisms, triangular pyramids, square pyramids, cylinders, cones, ellipsoids, oblate spheroids, tori, hour-glass geometries, three-dimensional clover geometries, regular three-dimensional shapes and irregular three-dimensional geometries as well as possibly other three-dimensional geometries. Examples of approximately two-dimensional geometries for sensory elements include, but are not limited to: discs, rings, as well as possibly other approximately two-dimensional geometries. Examples of still further geometries are discussed below and shown in FIG. 16.

Sensory elements may also be associated with various material properties or characteristics. For example, in some embodiments sensory elements may be comprised of relatively rigid or hard materials. In particular, sensory elements may be configured to resist compression or similar deformations under a predetermined level of force (e.g., the level of force commonly applied to the upper as it contacts a ball during kicks) since such deformations of the sensory elements may lead to reduced proprioception. Exemplary materials for sensory elements can include, but are not limited to: metal and/or plastics. Moreover, it may be understood that the hardness, rigidity and/or density of the material for sensory elements may be selected so that the sensory elements are relatively harder, more rigid and/or denser than adjacent portions of an upper.

Thus it may be understood that in at least some embodiments, sensory elements may be comprised of relatively compact material structures (ball-bearings, beads, etc.) that are relatively harder, more rigid and/or denser than surrounding portions of an article. Such a configuration, as discussed in further detail below, may allow for contact forces applied at an exterior of the upper to be transmitted directly to a foot. Specifically, the compact structure of the sensory elements provides a relatively small contact area with the contacting object (e.g., a ball) and with the foot, which helps reduce the tendency for contact forces to dissipate over larger regions of the upper. Also, the relatively high rigidity, high density and/or high hardness (in comparison to adjacent upper materials) reduces the tendency of the contact forces to dissipate due to compression.

FIGS. 1-6 illustrate an embodiment of article of footwear 100 having a plurality of sensory elements 200, also referred to simply as sensory elements 200. Sensory elements 200 are designed to indicate to a wearer of article 100 if an object (not shown) is contacting article 100. Sensory elements 200 may further enhance the wearer's awareness of where the ball is contacting article 100. This will be further discussed in detail below. In some embodiments, sensory elements 200 may be located in forefoot portion 10, midfoot portion 12, and/or heel portion 14. In the exemplary embodiment shown in FIGS. 1 and 2, sensory elements 200 are located throughout forefoot portion 10, midfoot portion 12, and heel portion 14 of article 100.

FIG. 1 is a front isometric view of an embodiment of article of footwear 100 having sensory elements 200. In order to further facilitate proprioception in certain portions of article 100, some embodiments of lacing system 101 may be offset to medial side 18 of article with respect to a central axis 800 of article 100 to allow additional sensory elements 200 on lateral side 16. In some embodiments, lacing system 101 may be centered with respect to upper 102. In other words, lacing system 101 may be aligned with, or lie directly over, central axis 800. Still, in other embodiments, lacing system 101 may be offset to lateral side 16 of article of article with respect to central axis 800 to allow additional sensory elements 200 on medial side 18.

Figure 2:
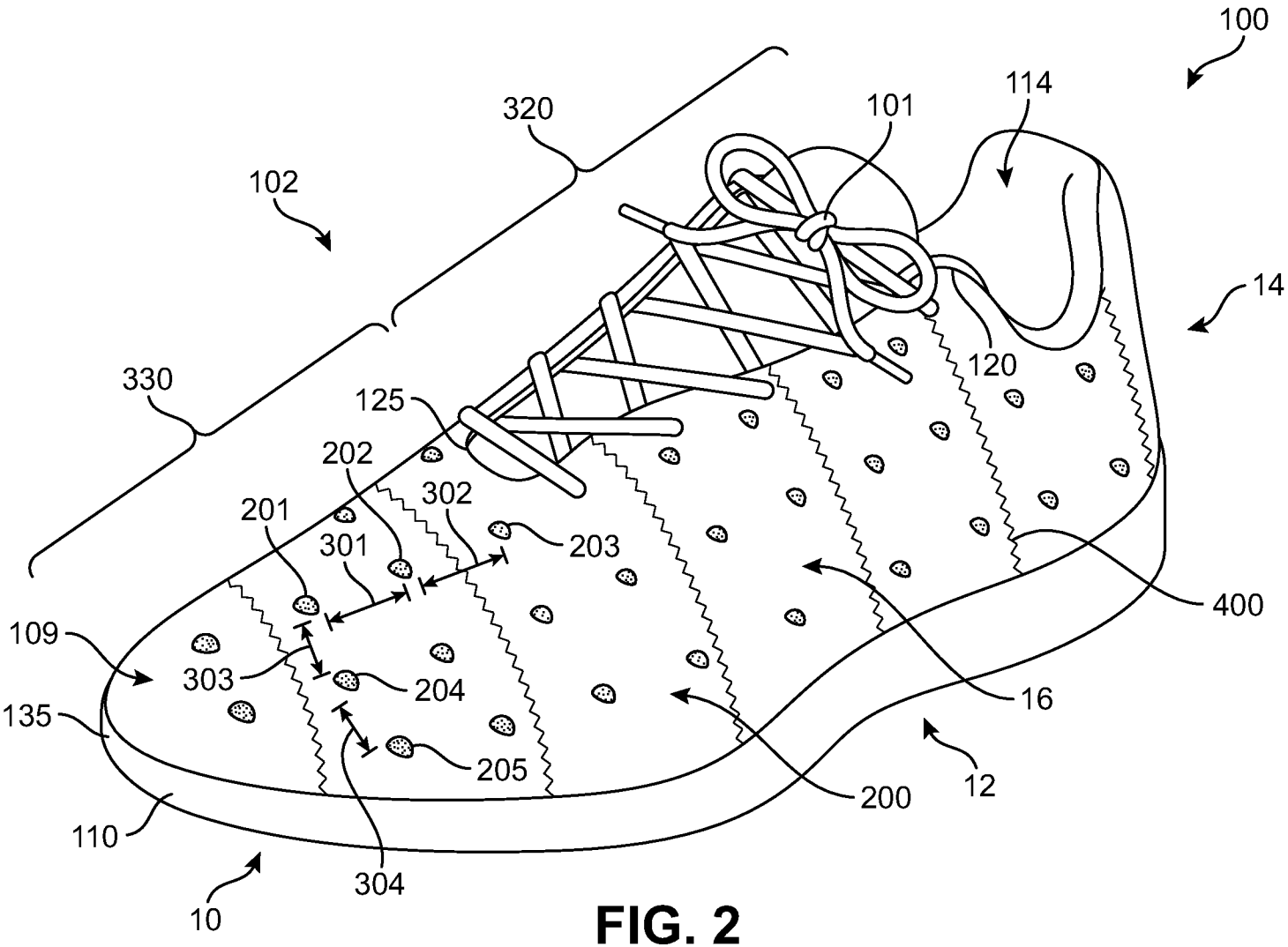
FIG. 2 is a side isometric view of the embodiment of the article of footwear shown in FIG. 1.

FIG. 2 is an isometric side view of the embodiment shown in FIG. 1. Generally, lacing system 101 spans a distance 320 from front edge 120 foot receiving portion 114 to rear edge 125 of forefoot portion 10. Forefoot portion 10 generally spans a distance 330 from rear edge 125 of forefoot portion 10 to a front edge 135 of sole structure 110. Traditional articles of footwear have a lacing system, or other fastening system, which generally have a longer distance, or length, than distance 320 of lacing system 101 shown in FIG. 2. However, in order to further facilitate proprioception in certain portions of article 100, distance 320 of lacing system 101 is approximately equal to distance 330 of forefoot portion 10 to allow additional sensory elements 200 on forefoot portion 10. In some embodiments, distance 320 of lacing system 101 is longer than distance 330 of forefoot portion 10. In other embodiments, distance 320 of lacing system 101 is shorter than distance 330 of forefoot portion 10 to allow further sensory elements 200 on forefoot portion 10.

FIGS. 1 and 2 show sensory elements 200 generally arranged in upper 102 in rows. Adjacent sensory elements 200 are generally evenly spaced apart within rows. Also, adjacent rows of sensory elements are generally evenly spaced apart. For example in FIG. 2, first sensory element 201 and second sensory element 202, adjacent to first sensory element 201, are spaced apart by first distance 301. Also, second sensory element 202 and third sensory element 203, adjacent to second sensory element 202, are spaced apart by second distance 302. In the embodiment in FIG. 2, first distance 301 is substantially identical to second distance 302. In other embodiments, first distance 301 could be greater than or less than second distance 302. Further, first sensory element 201 is spaced apart from fourth sensory element 204 by a third distance 303, fourth sensory element 204 being in an adjacent row to that of first sensory element 201. Also, fourth sensory element 204 is spaced apart from fifth sensory element 205 by a fourth distance 304, fifth sensory element 205 being in an adjacent row to that of fourth sensory element 204. In the embodiment in FIG. 2, third distance 303 is substantially identical to fourth distance 304. In other embodiments, adjacent rows of sensory elements 200 may not be evenly spaced apart.

The embodiment in FIGS. 1 and 2 show sensory elements 200 generally spaced evenly throughout upper 102. Such an arrangement may allow for an approximately even degree of proprioception over much of upper 102. In other embodiments, sensory elements 200 may be arranged in certain patterns which results in higher densities of sensory elements 200 in order to provide proprioceptive feedback targeted in specific locations of upper 102. For example, in other embodiments, sensory elements 200 could be arranged in a circular pattern on forefoot portion 10, midfoot 12, and/or heel portion 14. Still other patterns of sensory elements 200 could include, but are not limited to: linear patterns, non-linear patterns, regular patterns, irregular patterns as well as any other kinds of patterns.

FIGS. 1 and 2 also illustrate stitching 400 along upper 102. Stitching 400 may be used to attach first layer 103 to second layer 106 (discussed later). Stitching 400 may also be used to limit or prohibit sideways movement of sensory elements 200. In some embodiments, stitching 400 may generally extend from forefoot portion 10 to heel portion 14, or vice versa. In the embodiment shown in FIGS. 1 and 2, stitching 400 extends generally from medial side 18 to lateral side 16, or vice versa. In other embodiments, stitching 400 may generally extend in multiple directions, such as from medial side 18 to lateral side 16 and from forefoot portion 10 to heel portion 14.

Some embodiments of article 100 have an upper 102 with a single layer. The single layer generally includes cavities throughout forefoot portion 10, midfoot portion 12, and/or heel portion 14. The cavities are configured such that sensory elements may be inserted into upper 102 but may not be easily removed. In some embodiments, cavities are on the exterior portion of upper 102 such that an observer could see the sensory elements 200 even when a foot is inserted into article 100. In other embodiments, cavities are on the interior portion of upper 102 such that an observer could not see the sensory elements 200 when a foot is inserted into article 100. Also, the spacing between adjacent sensory elements and/or spacing between adjacent rows of sensory elements could vary in any manner as previously described in the earlier embodiment.

FIG. 3 illustrates an exploded view of an embodiment of upper 102 in order to clearly show the layered structure of upper 102. In some embodiments, upper 102 has a first layer 103 and a second layer 106, as well as sensory elements 200 between first layer 103 and second layer 106. First layer 103 includes first exterior portion 104 and first interior portion 105. First layer 103 further includes several apertures 250 corresponding to sensory elements 200, where the apertures 250 are configured to receive sensory elements 200. Second layer 106 includes second interior portion 107 and second exterior portion 108. Sensory elements 200 may be held in upper 102 between first layer 103 and second layer 106 when first interior portion 105 is engaged with second interior portion 107.

Figure 4:
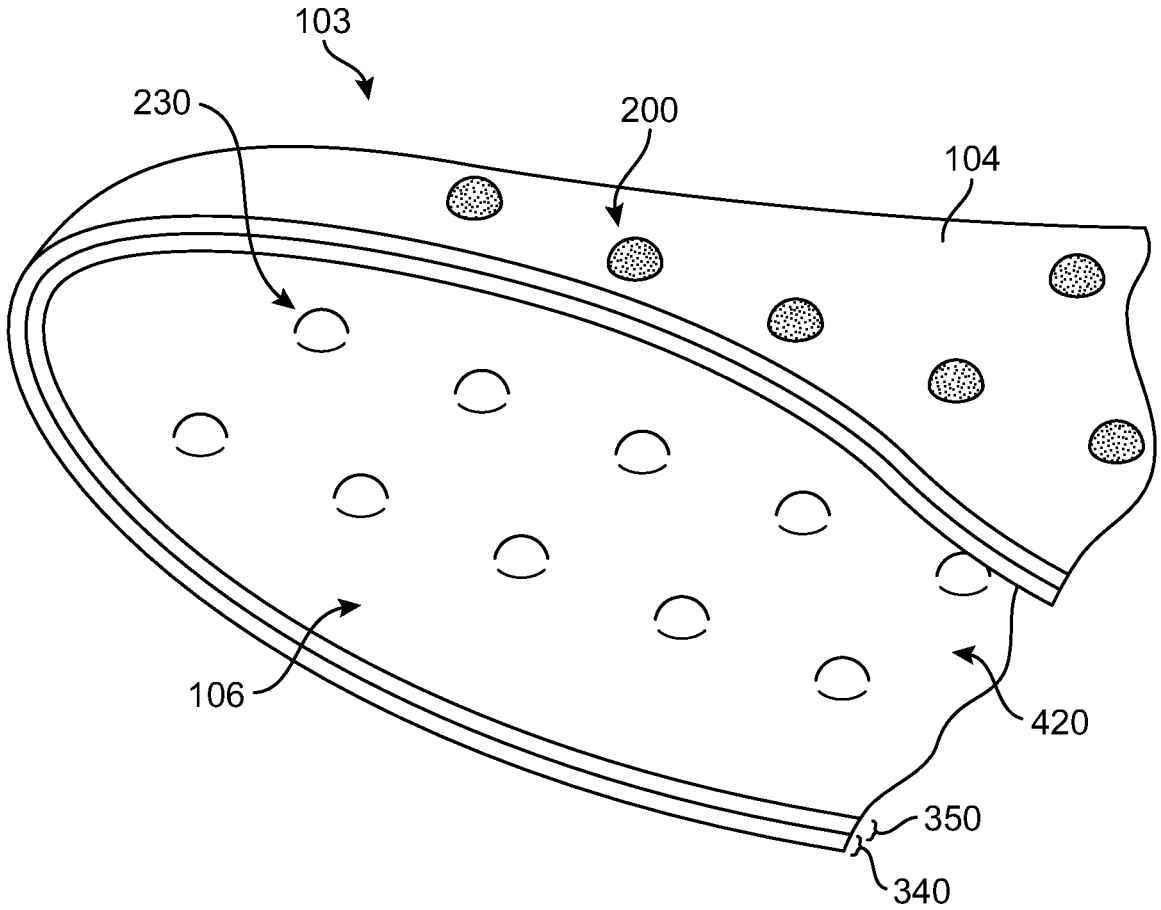
FIG. 4 is an enlarged view of the article of footwear shown in FIG. 1, showing an upper with sensory elements between first layer and second layer.

FIG. 4 is an enlarged view of a portion of upper 102 illustrating sensory elements between first layer 103 and second layer 106. Here, second layer 106 is seen to form an interior cavity 420 of article 100. For purposes of illustration, only a forefoot portion of article upper 102 is shown in FIG. 4, however a similar arrangement for first layer 103, second layer 106 and sensory elements 200 may apply to the remaining portions of upper 102.

In different embodiments, the thickness of one or more layers of upper 102 could vary. As indicated in FIG. 4, first layer 103 has first thickness 340, and second layer 106 has second thickness 350. In some embodiments, first thickness 340 is less than or approximately equal to second thickness 350. In the embodiment in FIG. 4, first thickness 340 is greater than second thickness 350. In this manner, first layer 103 is a robust layer of upper 102 providing protection to a foot against outdoor conditions (e.g., rain, snow) and preventing unwanted distal movement of sensory elements 200 (e.g., not allowing sensory elements to exit first layer). Further, second layer 106 may generally be a relatively thin layer to allow more room in interior cavity 420 for a foot.

As previously stated, in some embodiments, first layer 103 may be attached to second layer 106 by a stitching. In addition, in some embodiments, an adhesive layer (not shown) may be applied to first interior portion 105 of first layer 103 and/or second interior portion 107 of second layer 106 to adhesively connect first layer 103 to second layer 106. It will be understood that in other embodiments, any other methods know in the art for connecting material layers could be used to attach first layer 103 and second layer 106. As an example, an alternative embodiment could utilize ultrasonic welding methods to join first layer 103 and second layer 106.

As seen in FIGS. 3 and 4, second layer 106 lacks any apertures. As a result, sensory elements 200 are visible on an exterior portion of upper 102 (i.e., on first exterior portion 104 of first layer), but are not visible on an interior portion of upper 102 (i.e., the portion associate with interior cavity 420). In some embodiments, second exterior portion 108 of second layer 106 may form bulge elements 230 created by sensory elements 200 displacing second layer 106 from first layer 103. In other embodiments, second layer 106 may have second thickness 350 sufficiently large enough to decrease or eliminate any visible displacement of second exterior portion 108 of second layer 106. Still, in other embodiments, fist layer 103 may have first thickness 340 sufficiently large enough to decrease or eliminate any visible displacement in first exterior portion 104 of first layer 103.

Figure 5:
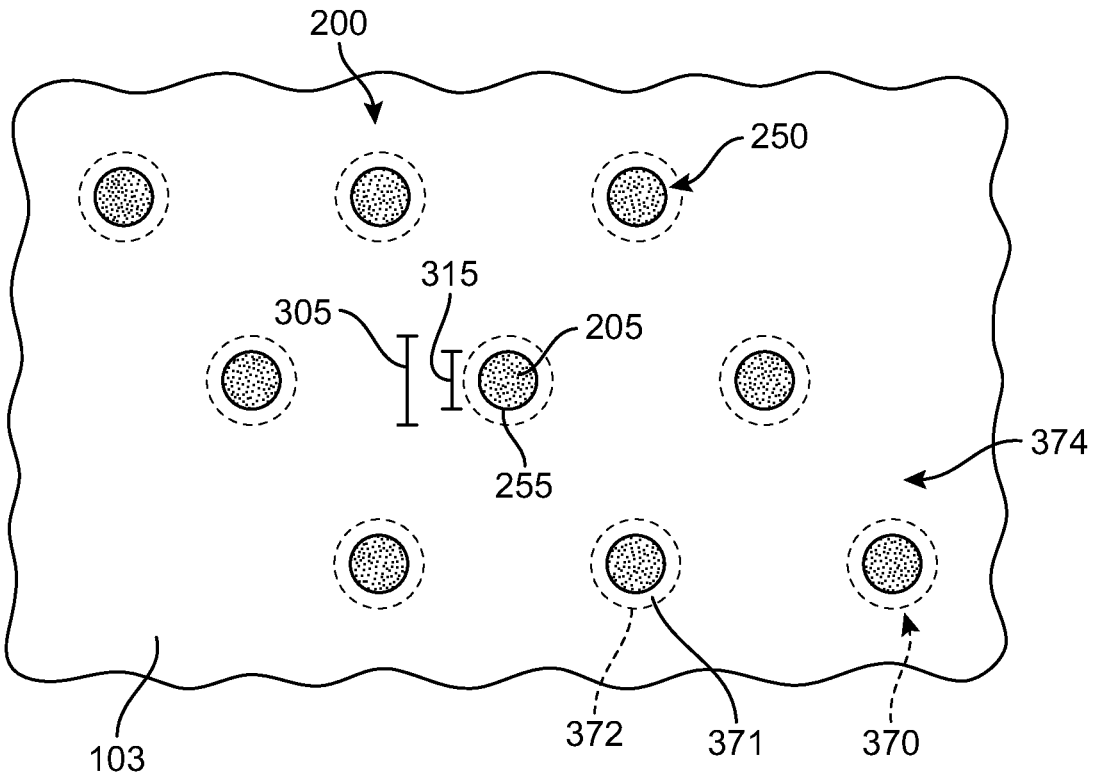
FIG. 5 is a top view of the article of footwear shown in FIG. 1, with sensory elements below first layer.
Figure 6:
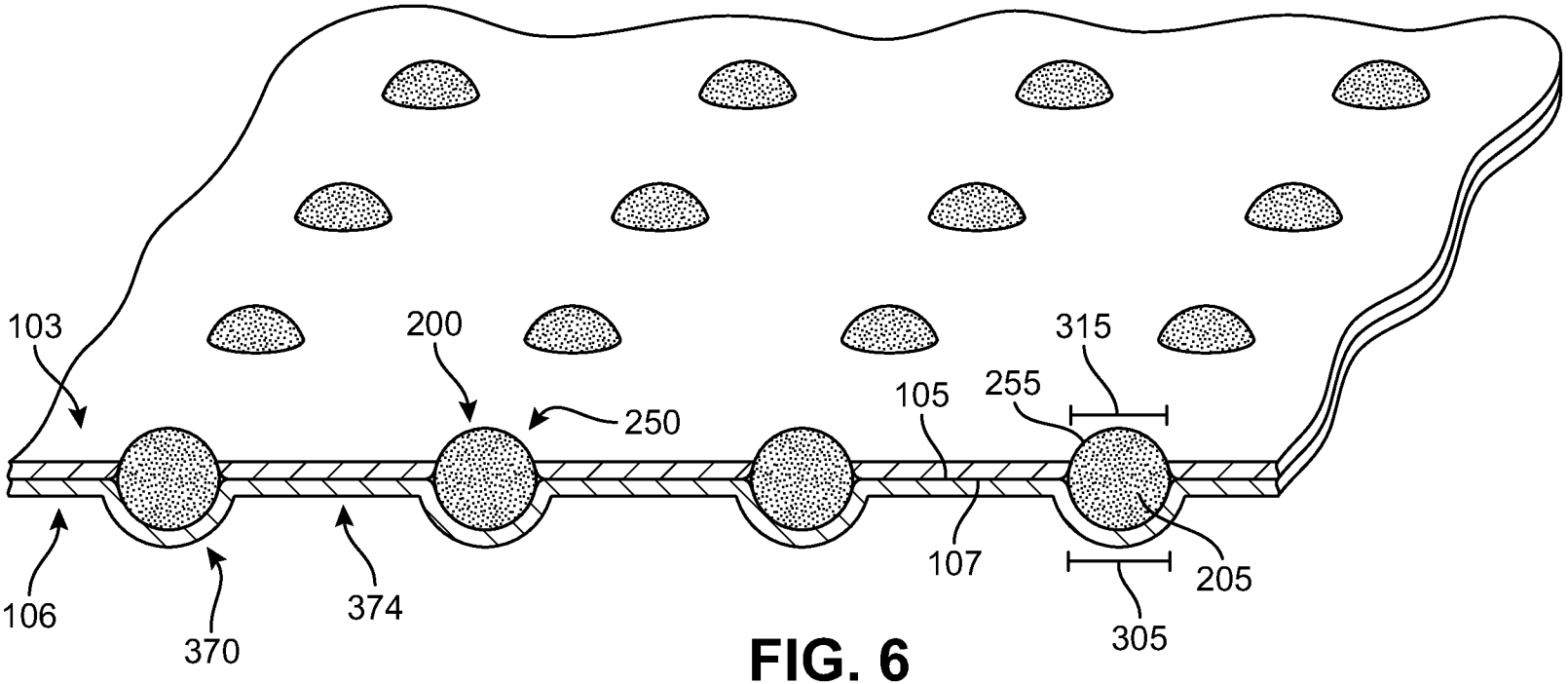
FIG. 6 is an enlarged view of the article of footwear shown in FIG. 1, showing an upper with sensory elements between first layer and second layer.
Figure 7:
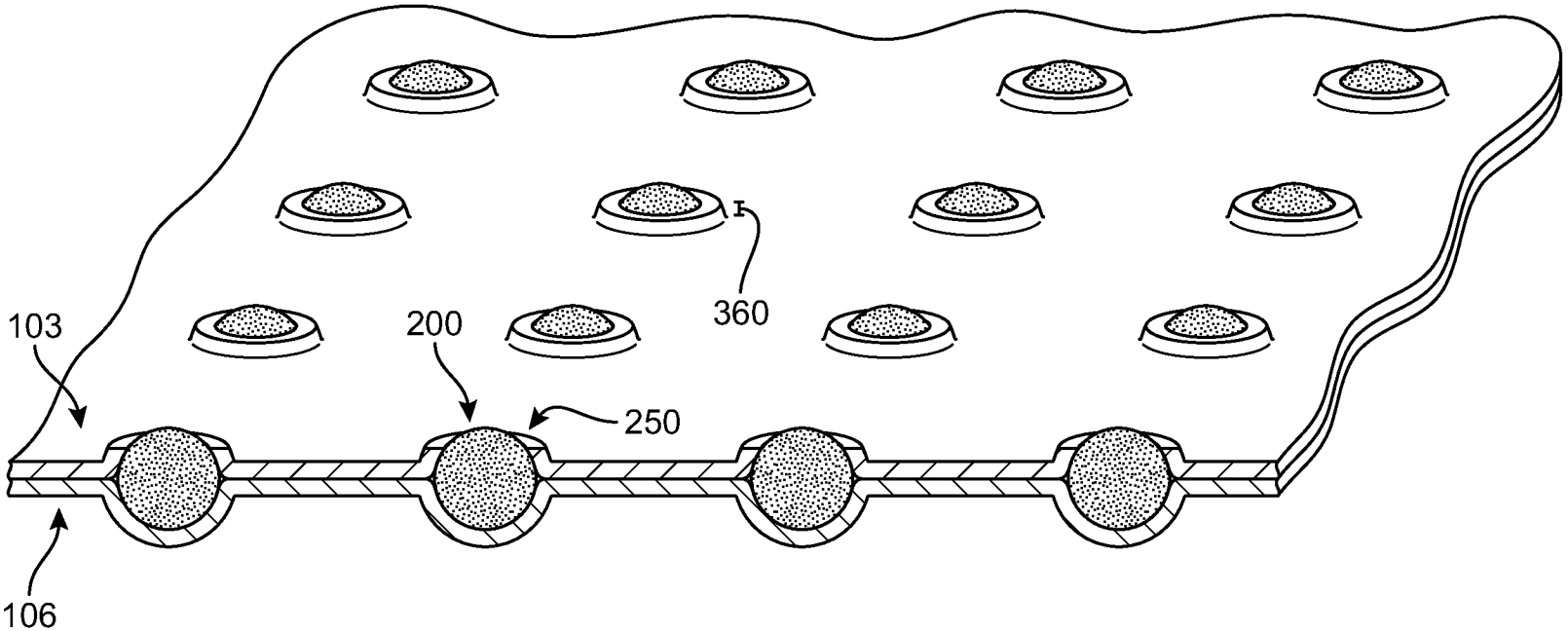
FIG. 7 is an enlarged isometric view of an alternative embodiment.

FIGS. 5-6 further illustrate an enlarged section of upper 102 with sensory elements 200 fixed between first layer 103 and second layer 106. The shape and size of the apertures in the first layer may vary according to the shape and size of the sensory elements. For example, in FIGS. 5-6, sensory elements 200 are generally spherical in shape, and accordingly, apertures 250 are generally circular. Of course, in other embodiments, apertures 250 could have any other shape. In some embodiments, the shapes of one or more apertures may generally be selected according to the corresponding geometry of the associated sensory elements. Generally, the size of an aperture is sufficiently smaller than the size of a sensory element such that a sensory element may partially protrude distally outward (i.e., outwardly away from a foot) with respect to an aperture but cannot escape through an aperture. In other words, a sensory element cannot traverse completely through an aperture. In FIGS. 5 and 6, diameter 315 of exemplary aperture 255 is smaller than diameter 305 of exemplary sensory element 205.

FIG. 6 is an isometric view of sensory elements 200 embedded between first layer 103 and second layer 106, with sensory elements 200 partially protruding from first layer 103. The partial protrusion of sensory elements 200 through apertures 250 may help limit or restrict sideways movement of sensory elements 200. Further, apertures 250 are generally co-planar with respect to first layer 103. In other embodiments, apertures 250 may not be co-planar with respect to first layer 103. For example in FIG. 7, which illustrates an isometric view of a portion of an upper according to an alternative embodiment, apertures 250 are raised with respect to first layer 103 by distance 360. In some embodiments, distance 360 may have a height approximately in the range between 0.001 mm and 2 mm. This configuration may further limit or restrict sideways movement of sensory elements 200.

An upper incorporating a plurality of sensory elements embedded within a base portion of the upper may be characterized as having a plurality of sensory portions. The term "sensory portion" as used in this detailed description and in the claims refers to portions of the upper that are in immediate contact with the plurality of sensory elements. A portion of the upper extending between the sensory portions may be referred to as an intermediate portion. Thus, the sensory portions of an upper may be associated with the specific locations on the upper where enhanced sensory information may be transmitted from the upper to a foot.

As seen in FIGS. 5-6, upper 102 may be characterized as having a plurality of sensory portions 370. Moreover, each sensory portion may be associated with an outer periphery. For example, sensory portion 371 is seen in FIG. 5 to have an outer periphery 372. Likewise, the remaining plurality of sensory portions 370 each have a corresponding outer periphery. The portion of upper 102 disposed between the outer peripheries of each sensory portion comprises intermediate portion 374. As seen in FIG. 6, first layer 103 and second layer 106 may be bonded or otherwise joined in intermediate portion 374. In contrast, first layer 103 and second layer 106 may be separated in plurality of sensory portions 370.

In the embodiments described in this detailed description and in the claims, structural elements of an article of footwear generally vary in hardness. For example, a first layer of upper has first hardness, a second layer of upper has second hardness and a sensory element has third harness. In some embodiments, the third harness is substantially greater than first hardness and is substantially greater than second hardness. Thus, while an upper may flex and deform, the sensory elements may not be compressed and therefore may transfer forces more directly to a foot than the layers of the upper.

Generally, a sensory element may be made from an elemental metal, metal alloy, plastic, or any hard material, as well as possibly other materials. The material could be selected to achieve desired proprioception and tactile forces between a foot and an object contacting the foot. In an exemplary embodiment, the materials used in making a sensory element can be selected so that the sensory elements are substantially harder than the upper layers.

Figure 8:
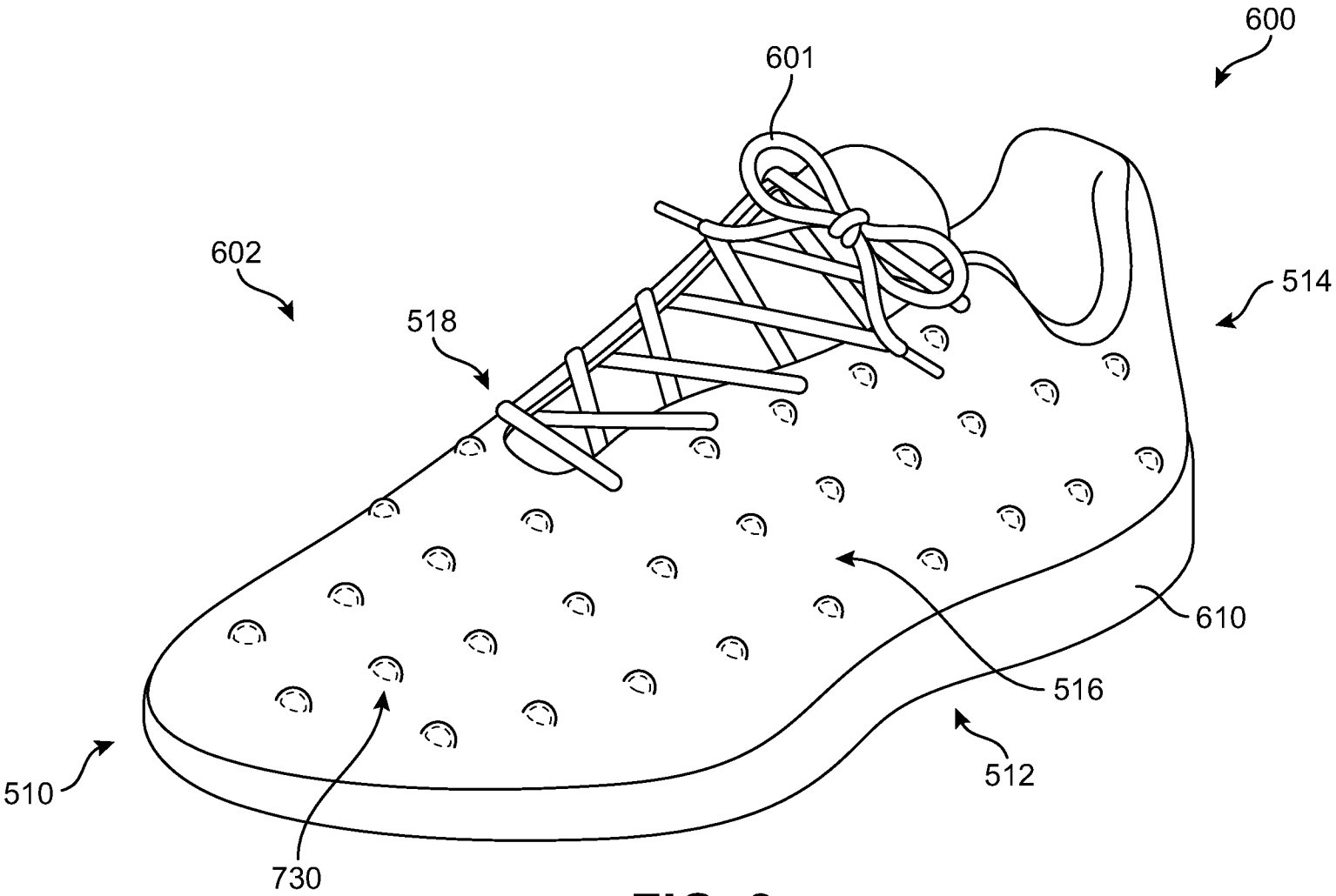
FIG. 8 is an isometric view of an another embodiment of an article of footwear having sensory elements fully embedded in an upper.
Figure 9:
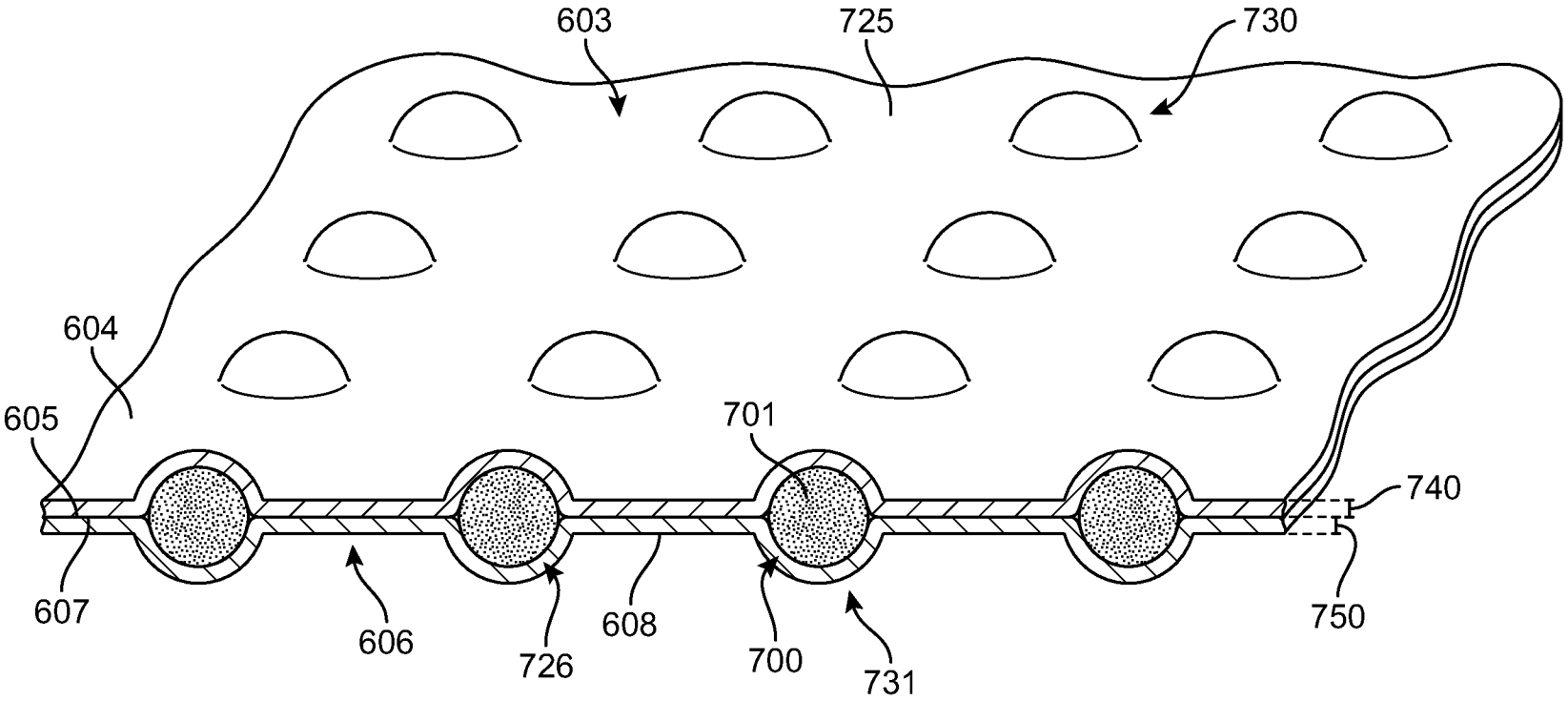
FIG. 9 is an enlarged view of the article of footwear shown in FIG. 8.
Figure 10:
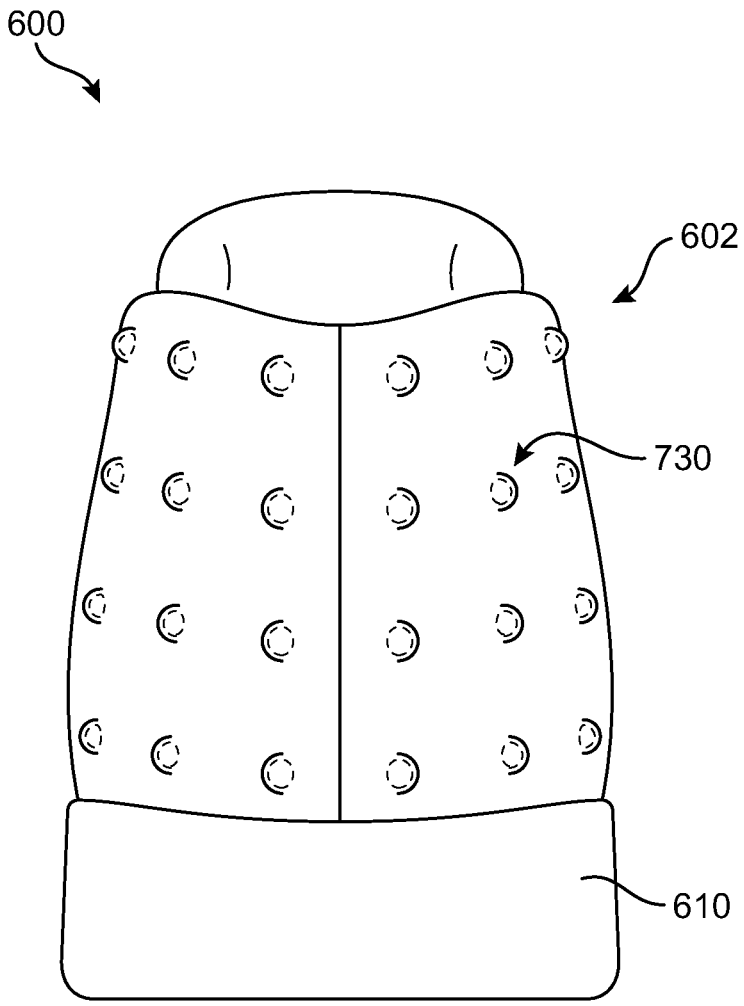
FIG. 10 is a rear view of a heel portion of the article of footwear shown in FIG. 8.

FIGS. 8-10 illustrate another embodiment of article of footwear 600 including upper 502 attached to sole structure 610, and further including sensory elements 700 fully embedded in upper 602. In other words, neither first layer 603 nor second layer 606 includes apertures to receive sensory elements 700, and therefore sensory elements 700 are not visible on an interior portion or an exterior portion of upper 602. FIG. 8 shows first bulge elements 730 representing portions of upper 602 where sensory elements 700 are located in upper 602. Sensory elements 700 in FIG. 8 are located in forefoot portion 510, midfoot portion 512, and heel portion 514. In other embodiments, sensory elements 700 could be anywhere on forefoot portion 510, midfoot portion 512, and/or heel portion 514.

Also, as seen in FIG. 8, article 600 includes lacing system 601. Lacing system 601 could vary in any manner previously described in the earlier embodiment. That is, lacing system 601 could be offset to lateral side 516 or medial side 518 of article 600, and/or lacing system 601 could vary in length in order to allow additional sensory elements 700 on forefoot portion 510. Article of footwear 600 in FIG. 8 is intended to be used with a left foot; however, it should be understood that the following description may equally apply to a mirror image of article of footwear that is intended for use with a right foot (not shown).

The fully embedded sensory elements 700 are fixed between a first layer and a second layer of an upper. FIG. 9 illustrates an enlarged section of upper 602 having an exemplary sensory element 701 fixed between first layer 603 and second layer 606. First layer 603 includes first exterior portion 604 and first interior portion 605, and second layer 606 includes second interior portion 607 and second exterior portion 608. First layer 603 is connected to second layer 606 by attaching first interior portion 605 to second interior portion 607. Intermediate portion 725 includes portions where first interior portion 605 is engaged with second interior portion 607. Further, attachments means of first layer 603 and second layer 606, via first interior portion 605 and second interior portion 607, may vary in any manner previously described in the earlier embodiment. Also, sensory elements 700 between first layer 603 and second layer 606 are generally restricted from sideways movement.

In the embodiment of article 600, the spacing between adjacent sensory elements are generally equal, and adjacent rows of sensory elements are generally spaced equally apart, as shown in FIGS. 8-10. However, spacing between adjacent sensory elements and/or spacing between adjacent rows of sensory elements could vary in any manner as previously described in the earlier embodiment.

Referring again to FIG. 9, first bulge elements 730 and second bulge elements 731 represent exterior bulges and interior bulges, respectively, of upper 602. The isometric cross section of FIG. 9 is intended to show sensory elements 700 fully embedded, and located between first layer 603 and second layer 606. FIG. 9 further shows sensory portions 726 where sensory elements contact first layer 603 and second layer 606, and in particular, where sensory elements 700 contact first interior portion 605 and second interior portion 607. It should be understood sensory elements 700 are not visible upper 602.

FIG. 9 also illustrates first layer 603 having first thickness 740 and second layer 606 having second thickness 750. First thickness 740 and second thickness 750 could vary in any manner as previously described in the earlier embodiment.

Figure 11:
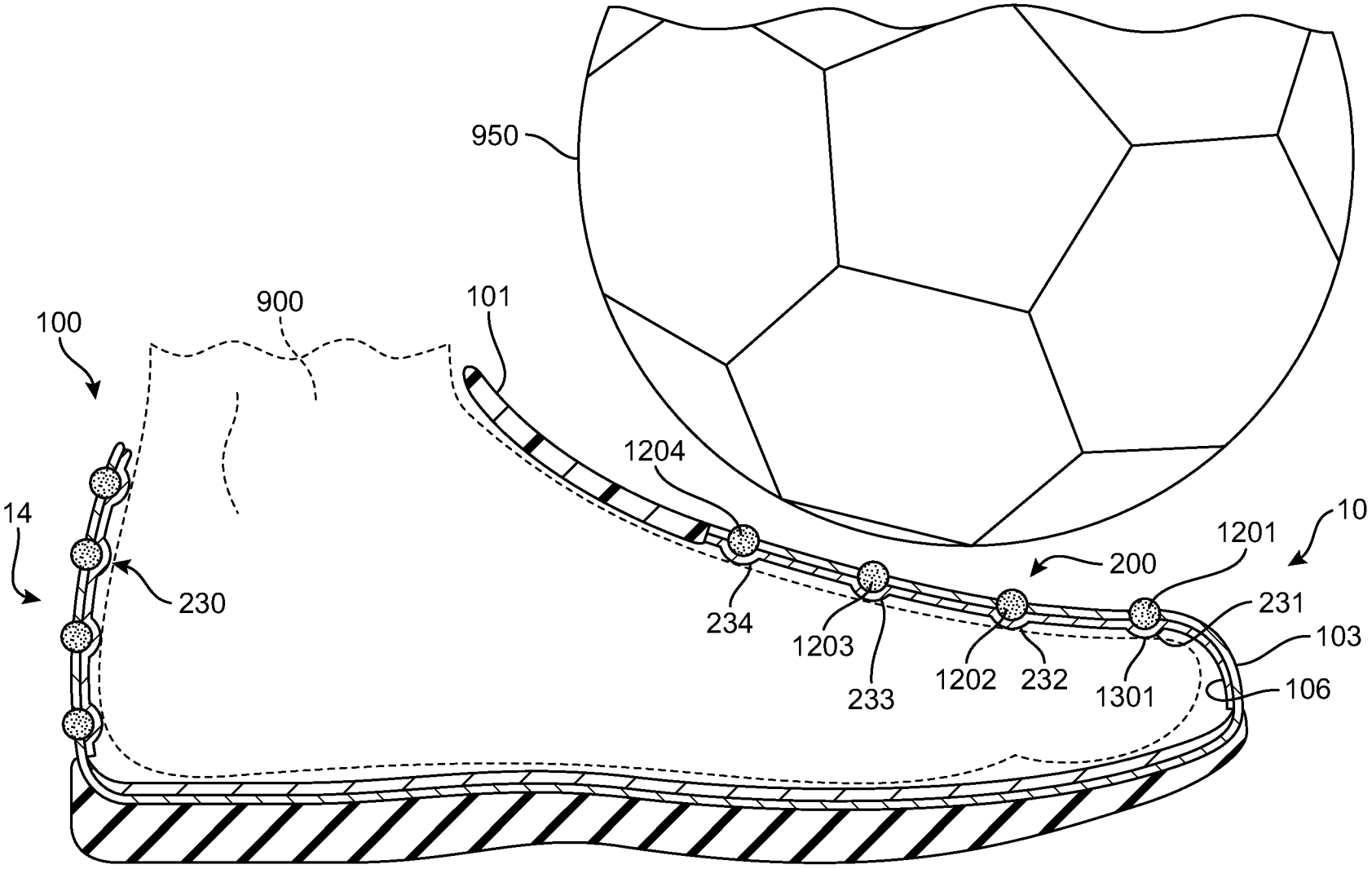
FIG. 11 is a lengthwise cross sectional view of the embodiment of the article shown in FIG. 1.
Figure 12:
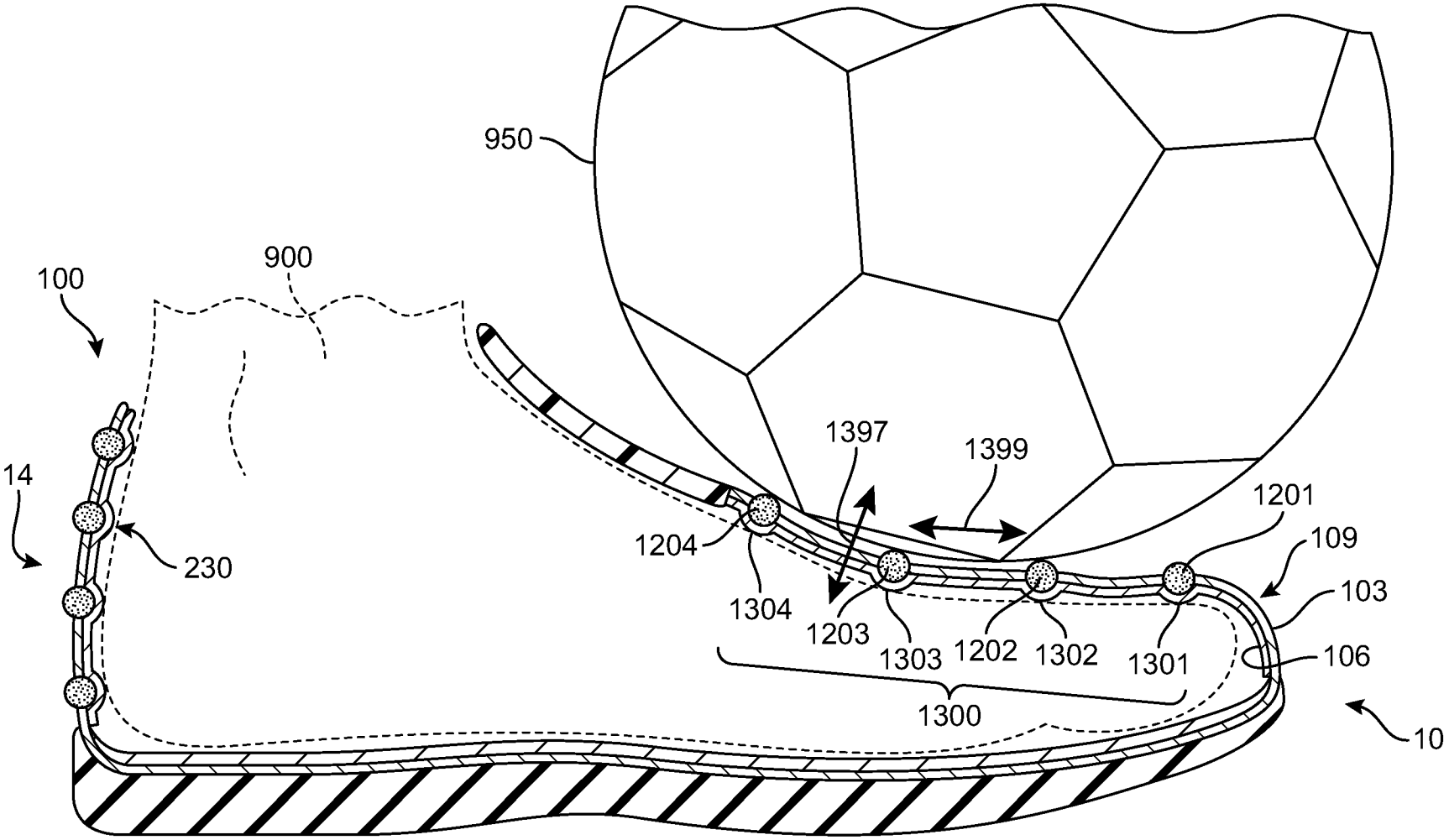
FIG. 12 is a lengthwise cross sectional view of the embodiment of the article shown in FIG. 1, with an object contacting the article.
Figure 13:
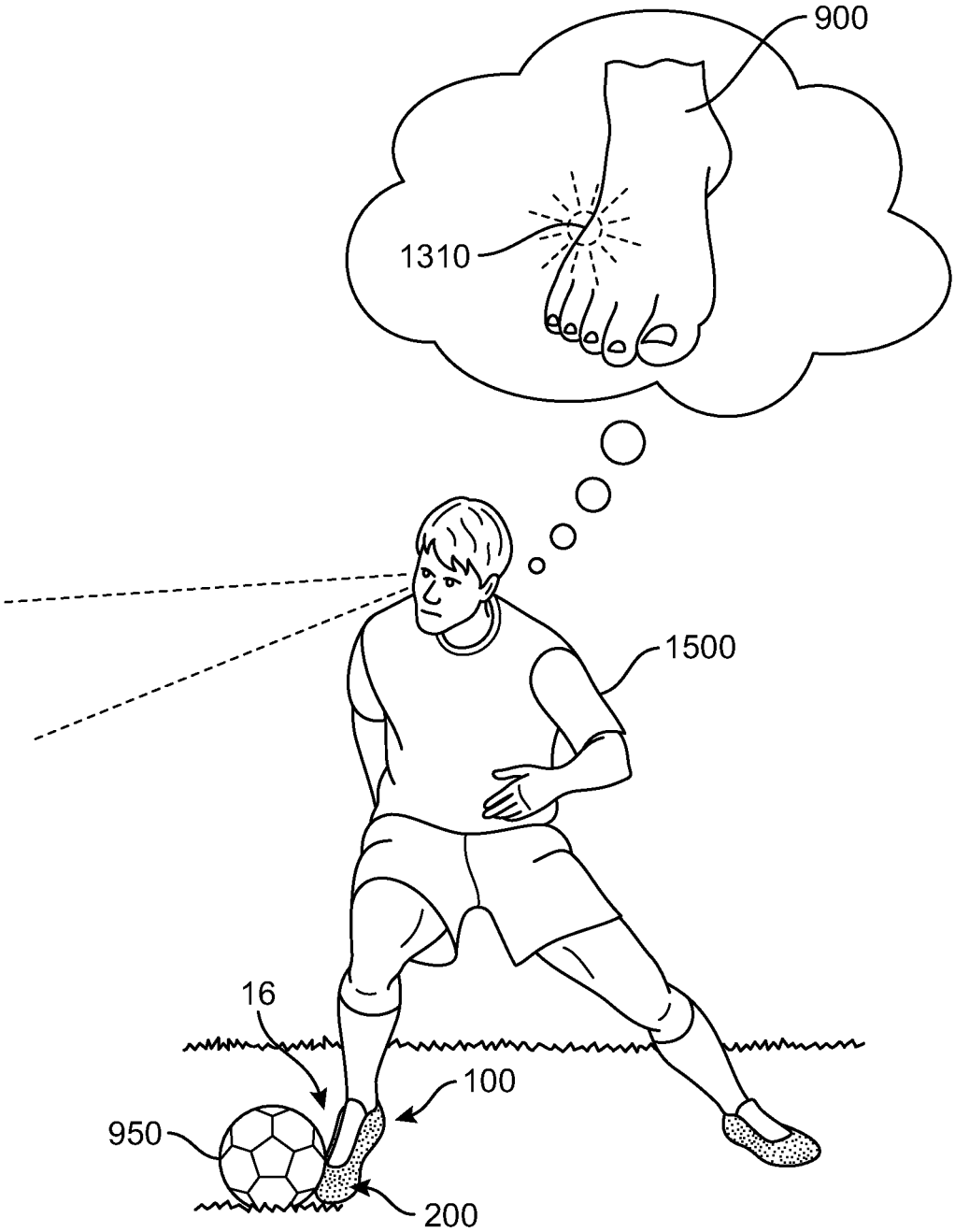
FIG. 13 illustrates a wearer of the embodiment of the article of footwear in FIG. 1, with a ball in contact with the article.

FIGS. 11-13 illustrate the functionality of sensory elements 200 when article 100 is worn. Generally, portions of article 100, such as forefoot portion 10, midfoot portion 12, and/or heel portion 14, may be displaced when contacted by three-dimensional object 950, or simply object 950. Object 950 could be any object. In FIGS. 11-13, object 950 is a ball. Exemplary balls include soccer balls, footballs, kick balls, as well as any other kinds of balls. In the exemplary embodiment, object 950 is a soccer ball.

When object 950 contacts sensory elements 200, sensory elements 200 are proximally displaced (e.g., sensory elements 200 are moved inwardly towards the interior of article 100). Accordingly, bulge elements 230 are proximally displaced creating contact points 1300 on foot 900. Contact points 1300 on foot 900 generally signal, via nerves, to a wearer of article 100 what portion of article 100 is being contacted by object 950. It should be understood that proximal displacement of sensory elements 200 signifies proximal displacement in corresponding bulge elements 230. Further, it will be understood that "contact point" is only intended for purposes of description and not intended to demarcate a specific amount of contact or depression. However, the amount of contact or depression may be directly proportional to proximal displacement of sensory elements 200.

FIG. 11 is a lengthwise cross sectional area of the embodiment in FIG. 1. First sensory element 1201 and second sensory element 1202 are generally located on forefoot portion 10, and third sensory element 1203 and fourth sensory element 1204 are generally located on midfoot portion 12. Foot 900 is disposed inside article 100. In other embodiments, a sock covering foot 900 may also be disposed in article 100. Contact points 1300 may nonetheless be sensed even when a sock is worn on foot 900.

Second layer 106 includes bulge elements 230 created by sensory elements 200 displacing second layer 106 from first layer 103. In the embodiment shown in FIG. 11, foot 900, when inserted into article 100, contacts first bulge element 231, second bulge element 232, third bulge element 233, and fourth bulge element 234. In other embodiments, any one or all bulge elements 230 may not be in contact with foot 900 (or sock, if applicable). Any one of bulge elements 230 contacting foot 900 may apply a first contact point 1301, or initial contact point, in an area immediately surrounding bulge elements 230 in contact with foot 900.

FIG. 12 is a lengthwise cross sectional area of the embodiment in FIG. 10, with object 950 contacting article 100. In particular, soccer ball 950 proximally displaces second sensory element 1202, third sensory element 1203, and fourth sensory element 1204, causing second contact point 1302, third contact point 1303, and fourth contact point 1304, respectively. First contact point 1301, having no contact with object 950, remains in an initial position. It should be understood that second contact point 1302, third contact point 1303, and fourth contact point 1304 are more proximally displaced into foot 900 as compared to first contact point 1301. FIG. 12 further illustrates varying proximal displacement, caused by object 950, among second sensory element 1202, third sensory element 1203, and fourth sensory element 1204. For example, proximal displacement of third sensory element 1203 is greater than that of second sensory element 1202 or fourth sensory element 1204. Accordingly, third contact point 1303 is more proximally displaced than second contact point 1302 or fourth contact point 1304. In this example, third contact point 1303 would alert wearer, without having to visibly see object 950, that object 950 is generally centered on a portion of midfoot portion 12, and in particular, around third sensory element 1203. Also, the relative degrees of contact may assist the wearer in determining specifically which portion(s) of article 100 are in contact with object 950.

FIGS. 11 and 12 clearly illustrate the modes of displacement that can be achieved by a plurality of sensory elements within an upper, according to certain embodiments. Referring to FIGS. 11 and 12, when contacted by object 950, a sensory element (e.g., third sensory element 1203) undergoes proximal displacement towards an interior of upper 102. In FIG. 12, this proximal displacement occurs along a direction indicated as proximal and distal direction 1397, where "proximal" is a direction toward foot 900 and "distal" is direction away from foot 900. Generally, this proximal displacement occurs as portions of upper 102 adjacent to the sensory element are also proximally displaced. For example, in the configuration of FIG. 12, third sensory element 1203 is displaced by object 950 upon contact with object 950. Third sensory element 1203, which is constrained between first layer 103 and second layer 106, pushes down on base portion 109 (comprised of first layer 103 and second layer 106). Therefore, third sensory element 1203 and the surrounding portions of base portion 109 of upper 102 are proximally displaced and may contact the foot.

However, in at least some embodiments such as the embodiment depicted in FIGS. 11 and 12, third sensory element 1203 does not move proximally with respect to base portion 109. Instead, third sensory element 1203 is fixed in place related to base portion 109. In particular, third sensory element 1203 is fixed within base portion 109 in a manner that prevents any relative movement of third sensory element 1203 with base portion 109, including both proximal/distal motion and motion in a direction approximately parallel with upper 102.

Still further, because sensory elements are embedded within base portion 109, the sensory elements may generally not be displaced in any direction approximately parallel to a surface of base portion 109. As an example, in the configuration shown in FIG. 12, third sensory element 1203 undergoes little to no displacement in a direction 1399, which is a direction approximately parallel with base portion 109. By limiting motion in directions oriented along base portion 109, this configuration may help ensure that sensory elements are primarily displaced proximally in order to efficiently transfer sensory information from an object in contact with article 100.

Generally, various kinds of information can be determined from contact with sensory elements. In some embodiments, contact from multiple sensory elements may alert a wearer to the approximate shape and/or size of the contacting object. Still further, in some embodiments, sensory information provided by the sensory elements may help a user to determine not only the location, but also the approximate trajectory of a ball, which could enhance activities such as imparting spin to a ball.

As previously discussed, sensory elements may be substantially harder or more rigid than at least some portions of an upper. Thus, while upper 102 may deform as a ball applies forces to the surface of upper 102, sensory elements 200 may not be compressed or otherwise deform. This allows sensory elements to transfer forces that might otherwise be dissipated by upper 102 directly from a ball to local regions of the foot. This configuration may thus improve proprioception over configurations of an article that lack relatively hard and incompressible sensory elements embedded within an upper.

To further illustrate the functionality of sensory elements 200, FIG. 13 illustrates a wearer 1500 using an embodiment of article of footwear 100. When ball 950 is generally on lateral portion 16 of article 100, wearer 1500 senses contact point 1310 on foot 900 and knows ball 950 is on lateral portion 16 without having to look down at ball 950. Wearer 1500 may, instead, observe a teammate (not shown) to which wearer 1500 is passing. Wearer 1500 could also be observing a soccer goal (not shown) to which wearer 1500 is going to kick the ball 950. In either example, wearer 1500 may make a move in a more efficient manner by not having to see where ball 950 is on foot 900. It will be understood the embodiments described in this detailed description and in the claims function in a similar manner to the function described in FIGS. 11-13.

Figure 14:
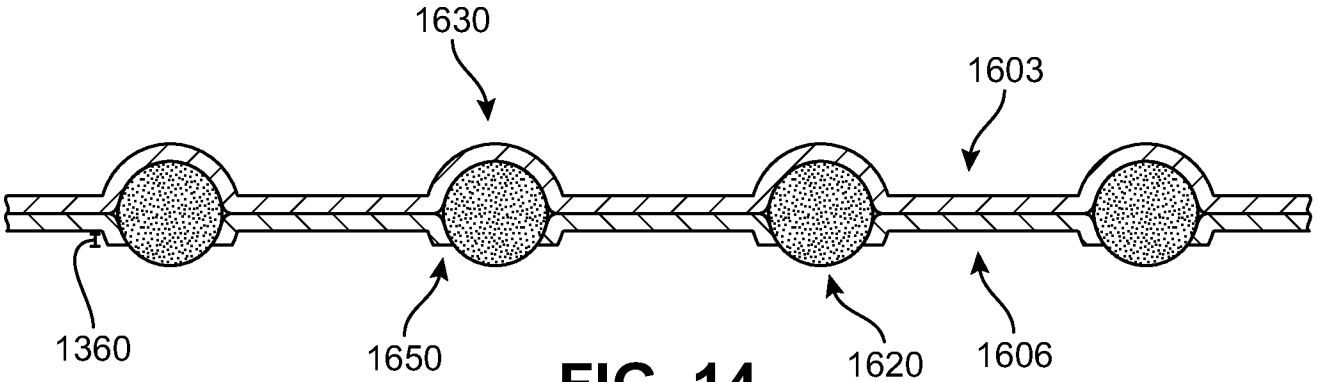
FIG. 14 is an enlarged view of an alternate embodiment of an upper with sensory elements protruding from the second layer.
Figure 15:
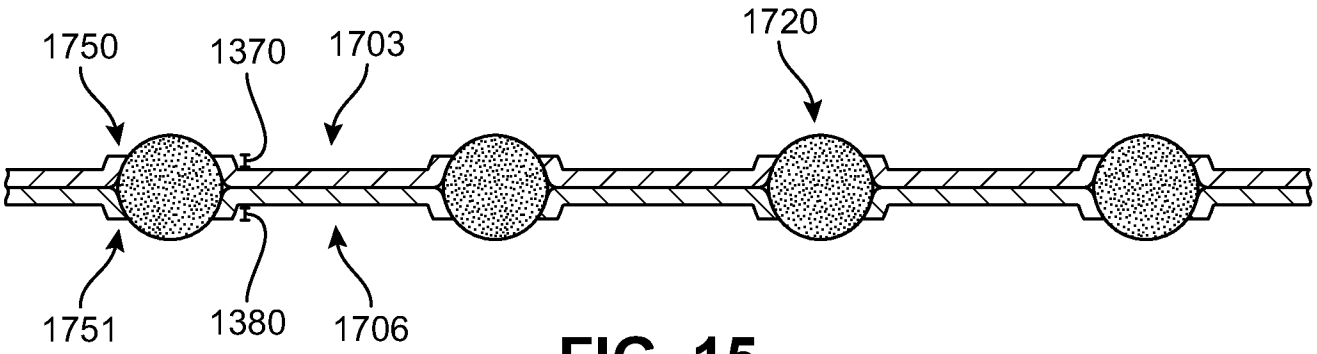
FIG. 15 is an enlarged view of an alternate embodiment of an upper with sensory elements protruding from the first layer and the second layer.
Figure 16:
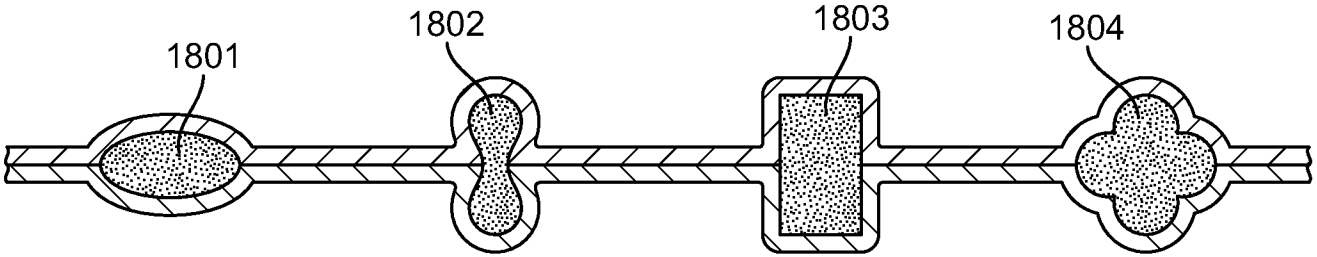
FIG. 16 is an enlarged view of an alternate embodiment of an upper with several embodiments of sensory elements.

There may be other embodiments of sensory elements embedded between a first layer and a second layer. For example, the embodiments FIGS. 14-16 illustrate different configurations of apertures and or shapes of sensory elements, which may allow for different levels of style, comfort, and/or sensitivity. It should be understood that attachment means of a first layer of an upper and second layer of an upper described in FIGS. 14-16 may vary in any manner previously described in the earlier embodiment.

FIG. 14 is an enlarged cross sectional view of an upper having first layer 1603 and second layer 1606, along with sensory elements fixed between first layer 1603 and second layer 1606, which may be an outer layer and an inner layer, respectively, of the upper. In this embodiment, second layer 1606 has apertures 1650 allowing sensory elements 1620 to partially protrude through second layer 1606. Sensory elements 1620 may generally contact a foot (not shown) when an upper constructed in the embodiment shown in FIG. 14 is worn. First layer 1603 does not include apertures, and so first layer 1603 has bulge elements 1630 displacing first layer 1603 from second layer 1606. Also, in some embodiments, apertures 1650 may be co-planar with second layer 1606. In the exemplary embodiment shown in FIG. 14, apertures 250 are raised with respect to second layer 1606 by distance 1360. This configuration may further limit or restrict sideways movement. Distance 1360 of raised apertures 250 may be in a range described in the earlier embodiment.

In other embodiments, a first layer of an upper may have apertures configured to receive sensory elements, and a second layer of an upper may have corresponding apertures also configured to receive sensory elements. For example, FIG. 15 is an enlarged cross sectional view of an upper having first layer 1703 having first apertures 1750, and second layer 1706 having second apertures 1751, along with sensory elements 1720 fixed between first layer 1703 and second layer 1706. In this embodiment, sensory elements 1720 may be visible when viewing either first layer 1703 or second layer 1706. Also, in some embodiments, apertures 1750 and apertures 1751 may be co-planar with first layer 1703 and second layer 1706, respectively. In the exemplary embodiment shown in FIG. 15, apertures 1750 are raised with respect to first layer 1703 by distance 1370, and apertures 1751 are raised with respect to second layer 1706 by distance 1380. This configuration may further limit or restrict sideways movement. Distance 1370 and distance 1380 of raised apertures 1750 and raised apertures 1751, respectively, may each be in a range described in the earlier embodiment. Generally, the size of the apertures described in FIGS. 14 and 15 is sufficiently smaller than the size of a sensory element such that a sensory element may partially protrude outward from an aperture but cannot escape through an aperture.

An upper having a first layer and a second layer may accommodate sensory elements comprising shapes other than a spherical shape. For example, FIG. 16 illustrates an oval-shaped sensory element 1801, an hour-glassed shaped sensory element 1802, a cylindrical element 1803, or a symmetrical, clover element. For purposes of clarity, only some exemplary shapes for sensory elements are shown, and other embodiments could have sensory elements with any other shapes including any regular and/or irregular shapes.

The sensory elements in FIG. 16 are fully embedded between a first layer of an upper and a second layer of an upper. An upper could include any of the embodiments of the sensory elements shown in FIG. 16, or a combination thereof. In some embodiments, apertures may be in the first layer and/or the second layer to allow any sensory element shown in FIG. 16 to partially protrude from first layer and/or second layer, respectively. In that case, the size of the apertures is sufficiently smaller than the size of a sensory element such that a sensory element may partially protrude outward from an aperture but cannot escape through an aperture.

In different embodiments, sensory elements may be configured with a variety of surface textures and/or surface configurations. In the exemplary embodiments of FIGS. 1-15, the spherical sensory elements are seen to have a generally rounded and smooth surface geometry. In another embodiment, however, the surface of a sensory element could be textured, for example, with small dimples. In still another embodiment, the surface of a sensory element could be faceted, with the surface forming various flat faces that may be configured in various different orientations. Still other embodiments could include sensory elements with ridges, grooves, and/or various other surface textures and/or configurations. Some surface features for a sensory element could modify traction between the sensory element and an object such as a ball. Surface textures and/or configurations may be selected according to various factors, including: desired sensory element orientation, desired traction (or grip) properties of the sensory element, as well as possibly other features.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a sole structure;

an upper connected to the sole structure, the upper comprising:

a first layer having a first exterior portion and a first interior portion;

a second layer having a second exterior portion and a second interior portion, wherein the first layer includes a plurality of apertures extending through the first layer from the first exterior portion of the first layer to the first interior portion of the first layer;

a plurality of discrete sensory elements disposed between the first layer and the second layer, wherein a first sensory element of the plurality of discrete sensory elements partially protrudes through a first aperture of the plurality of apertures;

wherein the upper further comprises a plurality of sensory portions corresponding to portions of the upper in contact with the plurality of discrete sensory elements;

wherein the upper further comprises an intermediate portion extending between the plurality of sensory portions;

wherein the second interior portion of the second layer is directly adjacent to and engaged with the first interior portion of the first layer in the intermediate portion of the upper and wherein the second interior portion is separated from the first interior portion at the plurality of sensory portions by the plurality of discrete sensory elements;

wherein the upper and the sole structure form a void at the second exterior portion of the second layer;

wherein the second exterior portion of the second layer forms bulge elements each having a rounded surface extending toward the void, and each of the plurality of discrete sensory elements is in direct contact with the second layer to displace the second layer from the first layer in a direction toward the void and away from the first layer to form the bulge elements each having a hemispherical shape;

wherein the second exterior portion of the second layer extends further into the void at the rounded surface of the bulge elements than at the intermediate portion; wherein the first sensory element is spherical in shape and the first aperture is substantially circular.

2. The article of footwear according to claim 1, wherein the first sensory element is exposed through the first layer by the first aperture.

3. The article of footwear according to claim 2, wherein the first sensory element is disposed in a forefoot region of the upper in a position overlying a portion of the void that is designed to receive a wearer's toes.

4. The article of footwear according to claim 1, wherein the diameter of the first sensory element is smaller than the diameter of the first aperture.

5. The article of footwear according to claim 1, wherein the plurality of discrete sensory elements are moveable in a distal direction and a proximal direction, and wherein the plurality of discrete sensory elements are not moveable in a direction approximately parallel to the first layer.

6. The article of footwear according to claim 5, wherein the first sensory element is proximally displaced when an object contacts the first sensory element.

7. The article of footwear according to claim 5, wherein the first sensory element is proximally displaced when an object contacts a layer of the upper that is disposed between the object and the first sensory element.

8. The article of footwear according to claim 1, wherein:

the first layer has a first hardness, the second layer has a second hardness, and the plurality of discrete sensory elements has a third hardness;

wherein the third hardness is greater than the first hardness; and wherein the third hardness is greater than the second hardness.

9. The article of footwear according to claim 1, wherein a first bulge element of the bulge elements is disposed opposite the first aperture.

10. The article of footwear according to claim 1, wherein a second sensory element of the plurality of discrete sensory elements partially protrudes through a second aperture of the plurality of apertures.

11. The article of footwear according to claim 10, wherein the second sensory element is exposed through the first layer by the second aperture.

12. An article of footwear, comprising:

a sole structure;

an upper connected to the sole structure, the upper comprising:

a first layer having a first exterior portion and a first interior portion;

a second layer having a second exterior portion and a second interior portion, wherein the first layer includes a plurality of apertures extending through the first layer from the first exterior portion of the first layer to the first interior portion of the first layer;

a plurality of sensory elements disposed between the first layer and the second layer, wherein a first sensory element of the plurality of sensory elements partially protrudes through a first aperture of the plurality of apertures such that the first sensory element is exposed by the first aperture;

wherein the upper and the sole structure define a void configured to receive a foot of a wearer at the second exterior portion of the second layer;

wherein the second exterior portion of the second layer forms bulge elements, and each of the plurality of sensory elements is in direct contact with the second layer to displace the second layer from the first layer in a direction toward the void and away from the first layer to form the bulge elements each having a hemispherical shape;

wherein the second layer is secured directly to the first layer at an intermediate portion of the upper between the bulge elements such that the first layer is in direct contact with the second layer at the intermediate portion of the upper between the bulge elements;

wherein the second exterior portion extends further into the void at the bulge elements than at the intermediate portion; and wherein the first sensory element is disposed in a forefoot region of the upper in a position overlying a portion of the void that is designed to receive a wearer's toes; wherein the first sensory element is spherical in shape and the first aperture is substantially circular.

13. The article according to claim 12, wherein the first sensory element is spherical in shape and a surface of a first bulge element of the bulge elements extending into the void and corresponding with the first sensory element is rounded in correspondence with the first sensory element.

14. The article according to claim 13, wherein the first bulge element of the bulge elements is disposed opposite the first aperture.

15. An article of footwear, comprising:

a sole structure;

an upper connected to the sole structure, the upper comprising:

a first layer having a first exterior portion and a first interior portion;

a second layer having a second exterior portion and a second interior portion, wherein the first layer includes a plurality of apertures extending through the first layer from the first exterior portion of the first layer to the first interior portion of the first layer;

a plurality of sensory elements disposed between the first layer and the second layer, wherein a first sensory element of the plurality of sensory elements partially protrudes through a first aperture of the plurality of apertures such that the first sensory element is exposed at the first exterior portion of the first layer by the first aperture;

wherein the positions of the plurality of sensory elements are fixed with respect to the first layer and the second layer;

wherein the upper and the sole structure form a cavity at the second exterior portion of the second layer;

wherein the second exterior portion of the second layer forms convex bulge elements, where the sensory elements are fixed between the first layer and the second layer;

wherein each of the plurality of sensory elements is in direct contact with the second layer to displace the second layer from the first layer in a direction toward the cavity and away from the first layer to form the convex bulge elements each having a hemispherical shape;

wherein convex portions of the convex bulge elements extend into the cavity; and wherein each of the plurality of sensory elements is substantially incompressible; wherein the first sensory element is spherical in shape and the first aperture is substantially circular.

16. The article according to claim 15, wherein the convex bulge elements correspond with the plurality of sensory elements.

17. The article according to claim 16, wherein the diameter of the first sensory element is smaller than the diameter of the first aperture.

* * * * *